US005971786A

United States Patent [19]

Beck

[11] Patent Number: 5,971,786

[45] Date of Patent: Oct. 26, 1999

[54] LIQUID-PROOF PLUG CONNECTOR

[75] Inventor: Bernhard Beck, Stuttgart, Germany

[73] Assignee: Endress + Hauser Conducta Gesellschaft fur Mess- und Regeltechnik mbH & Co., Gerlingen, Germany

[21] Appl. No.: 09/090,935

[22] Filed: Jun. 5, 1998

[30] Foreign Application Priority Data

Jun. 5, 1997 [DE] Germany ..... 197 23 684

[51] Int. Cl.[6] ..... H01R 4/38

[52] U.S. Cl. ..... 439/320; 439/271

[58] Field of Search ..... 439/320, 587, 439/588, 589, 271, 274, 275, 483, 139, 610, 322, 323

[56] References Cited

U.S. PATENT DOCUMENTS

| | | | |
|---|---|---|---|
| 1,944,719 | 1/1934 | Regenauer | 439/320 |
| 3,001,804 | 9/1961 | Tomlinson et al. . | |
| 3,452,321 | 6/1969 | Carissimi | 439/483 |
| 4,500,153 | 2/1985 | Mattingly, Jr. et al. . | |
| 4,531,796 | 7/1985 | Gansert et al. . | |
| 4,808,127 | 2/1989 | Swanic | 439/139 |
| 5,478,254 | 12/1995 | Holt . | |
| 5,567,174 | 10/1996 | Ericson, Jr. et al. . | |
| 5,672,076 | 9/1997 | Inaba | 439/610 |
| 5,711,066 | 1/1998 | Castaldo | 439/588 |

FOREIGN PATENT DOCUMENTS

| | | |
|---|---|---|
| 1292738 | 3/1962 | France . |
| 1 515 685 | 7/1970 | Germany . |
| 87 09 988 U | 10/1987 | Germany . |
| 374254 | 2/1964 | Switzerland . |
| 878602 | 10/1961 | United Kingdom . |

*Primary Examiner*—Steven L. Stephan
*Assistant Examiner*—Javaid Nasri
*Attorney, Agent, or Firm*—Jones, Tullar & Cooper, P.C.

[57] ABSTRACT

A liquid-proof plug connector, for example for two cables to be connected, is described, which is provided with a plug and a coupling to which the two cables can be connected. The plug connector is furthermore provided with a plug housing and a coupling housing in which the plug and the coupling are housed, and with a locking ring by means of which the plug housing and the coupling housing can be screwed together. The plug housing and the coupling housing have an overlapping area in the screwed-together state, in which a seal between the two housings is arranged.

6 Claims, 3 Drawing Sheets

LIQUID-PROOF PLUG CONNECTOR

BACKGROUND OF THE INVENTION

1. Technical Field

The present invention relates to a liquid-proof plug connector, for example for two cables to be connected, with a plug and a coupling to which the two cables can be connected, with a plug housing and a coupling housing in which the plug and the coupling are housed, and with a locking ring, by means of which the plug housing and the coupling housing can be screwed together.

2. Background of Art

Such a plug connector is known from measuring technology, for example, as a so-called SMEK plug. For example, with the aid of the plug connector it is possible to electrically connect two cables with each other. Alternatively it is also possible to electrically connect a sensor with a cable, or to electrically connect two components with each other in general. For employment in environmental technology in particular it is required, that the plug connector be liquid-proof. For this purpose the known SMEK connector is provided with a total of six seals. One seal each is arranged between the plug housing, or respectively the coupling housing, and the locking ring. It is achieved by means of this that in the screwed-together state no liquid in the area of the closure ring can penetrate into the two housings. Furthermore, two seals each are arranged between the plug housing, or respectively the coupling housing and the respective associated component. It is achieved by means of this that the plug housing and the coupling housing are liquid-proof at their ends facing the two associated components.

SUMMARY OF THE INVENTION

It is the object of the present invention to provide a liquid-proof plug connector having fewer seals.

This object is attained by means of the present invention in connection with a plug connector of the type mentioned at the outset in that the plug housing and the coupling housing have an overlapping area in the screwed-together state, and that a seal between the two housings is arranged in the overlapping area.

It is achieved by means of this that only a single seal is required, by means of which penetration of liquid into the plug housing or the coupling housing is prevented.

Although it is possible that liquid will get between the locking ring and the two housings since, in contrast to the prior art, no seals are provided there, this is unimportant, since further penetration of the liquid into the two housings is prevented in any case by the overlapping area between the plug housing and the coupling housing. In accordance with the present invention, one seal is saved when compared with the prior art by means of the seal arranged in the overlapping area between the plug housing and the coupling housing.

A further advantage lies in that the seal, arranged in accordance with the present invention, is at no time subjected to stress by a rotating movement or the like, even when the plug housing and the coupling housing are being screwed together. Only the locking element performs a rotating movement, while the plug housing and the coupling housing do not rotate. Seal wear in particular is reduced in this way, and the service life of the seal is considerably increased.

In advantageous embodiments of the present invention the coupling housing is arranged in the overlapping area on the exterior of the plug housing, or respectively the locking ring is arranged in the overlapping area on the outside of the coupling housing. Therefore, from the inside to the outside there is first the plug housing, then the coupling housing and then the locking ring. When assembling the plug connector the plug housing therefore almost automatically finds its way into the coupling housing. In this way it is achieved that the plug housed in the plug housing can be connected in a particularly simple manner with the coupling housed in the coupling housing.

In an advantageous further development of the present invention the seal is arranged on the exterior of the plug housing. In this way it is always possible for a user to check the functionality of the seal on the plug housing in a simple manner by a visual check.

It is particularly useful when the seal is provided in the form of an O-ring made of rubber. In this way it is possible to achieve a secure and at the same time cost-effective seal of the plug housing and the coupling housing.

In an advantageous further development of the present invention the locking ring is rotatably connected with the coupling housing and has an interior thread, and the plug housing has an exterior thread matched to the interior thread. By means of this the introduction of the plug housing into the coupling housing is further made easier during the assembly of the plug connector. The plug housing is guided by the locking ring, which is rotatably maintained on the coupling housing and therefore automatically enters the coupling housing. If thereafter the plug housing and the coupling housing are screwed together by means of the locking ring, the overlapping area with the seal arranged between the two housings is automatically created.

In an advantageous embodiment of the present invention, the plug housing and the coupling housing each have a seal at their ends facing the two cables, which is arranged between the respective cable and the respective housing. In this way it is achieved that only a single seal is required at each one of the ends of the two housings facing the two cables, by means of which liquid penetration into the plug housing or the coupling housing is prevented. Thus, in accordance with the present invention, respectively one seal is saved in comparison with the prior art by means of the seal disposed at each end of the two housings.

It is particularly useful if a rubber bushing is provided as the seal. By means of this it is possible to achieve a secure and at the same time cost-effective seal of the plug housing and the coupling housing with respect to the cables.

In an advantageous further development of the present invention the plug housing and the coupling housing have a cap, in particular a screwable cap, at the ends facing the two cables. In this way it is possible to introduce the cables into the plug connector at the ends of the two housings in a simple manner and to connect them with the plug and the coupling. It is furthermore possible for a user to test the functionality of the seal on the ends of the two housings in a simple manner, in particular by a visual check, when the cap has been removed.

In an advantageous embodiment of the present invention the plug housing, the coupling housing and the locking ring are made of plastic. In this way the plug connector in accordance with the present invention is acid- and base-resistant, and can be employed in connection with environmental technology in particular.

Further characteristics, possible uses and advantages of the present invention ensue from the subsequent description of exemplary embodiments of the present invention, which are represented in the drawing Figures. In this case all described or represented characteristics constitute the subject of the present invention, either by themselves or in any arbitrary combination, independently of their combination in the claims or their dependency, and independently of their wording, or respectively representation in the description, or respectively in the drawings.

DETAILED DESCRIPTION OF THE PREFERRED EMBODIMENTS

Figure 1:
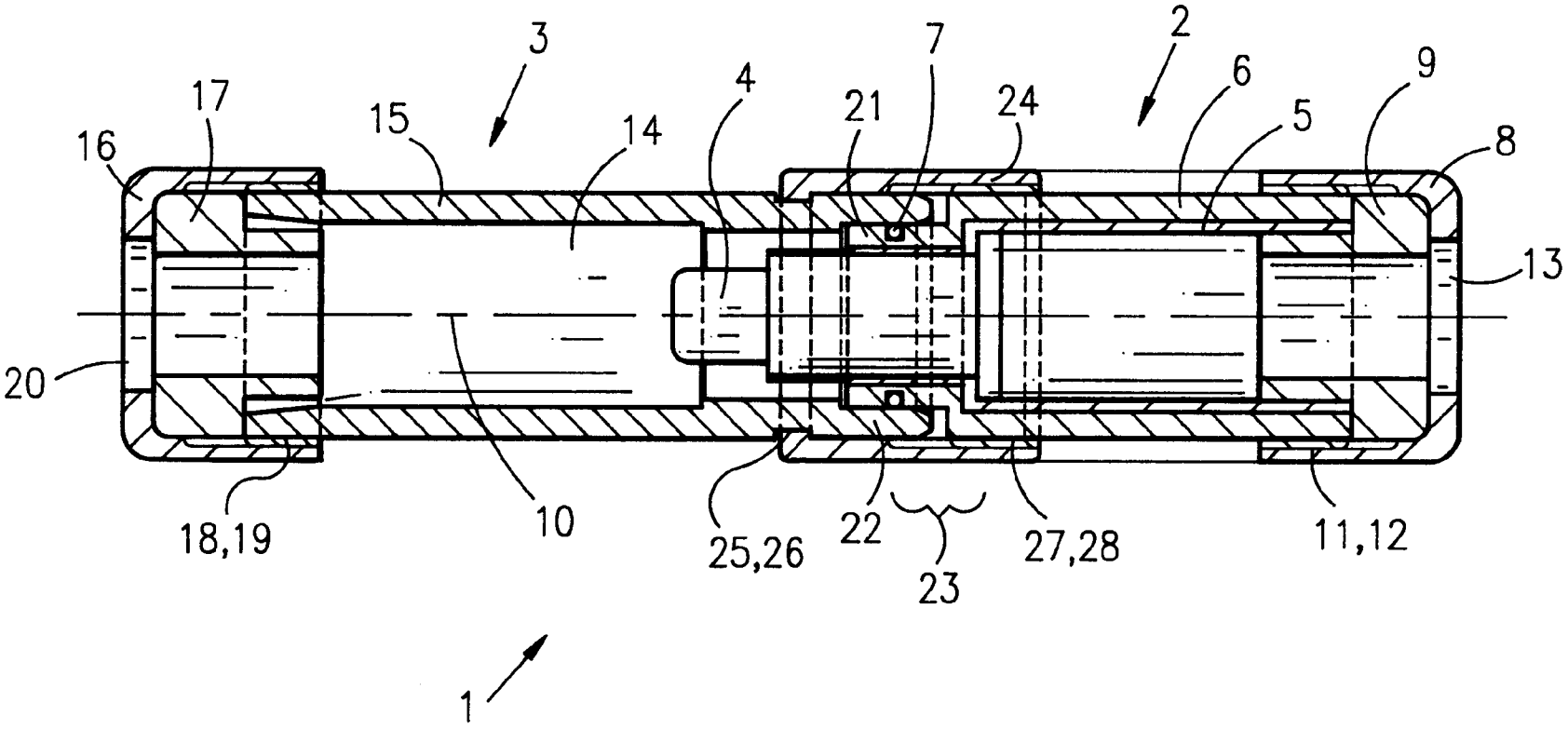
FIG. 1 represents a schematic longitudinal section of an exemplary embodiment of a plug connector in accordance with the present invention in its screwed-together state, wherein the plug connector has a plug element and a coupling element.
Figure 2A:
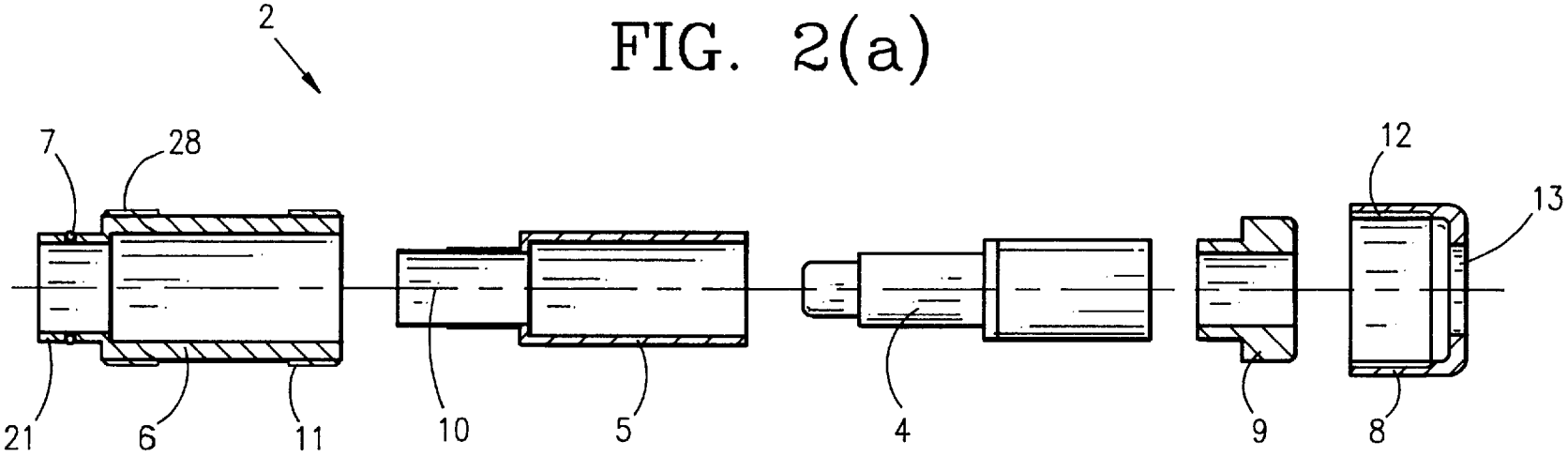
FIG. 2 represents a schematic longitudinal section of the plug element in FIG. 1 in the assembled state and in its details.
Figure 2B:
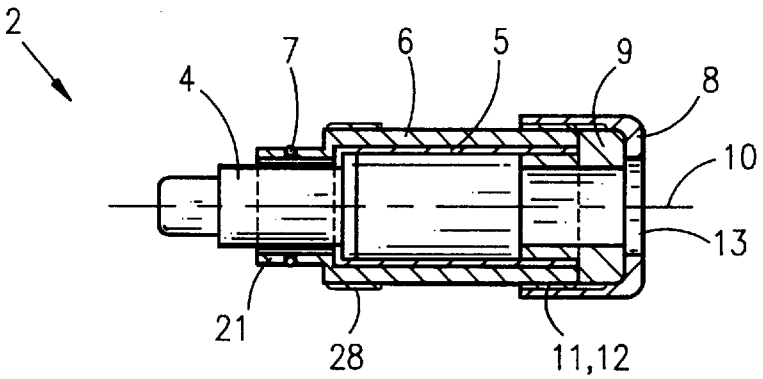
Figure 3A:
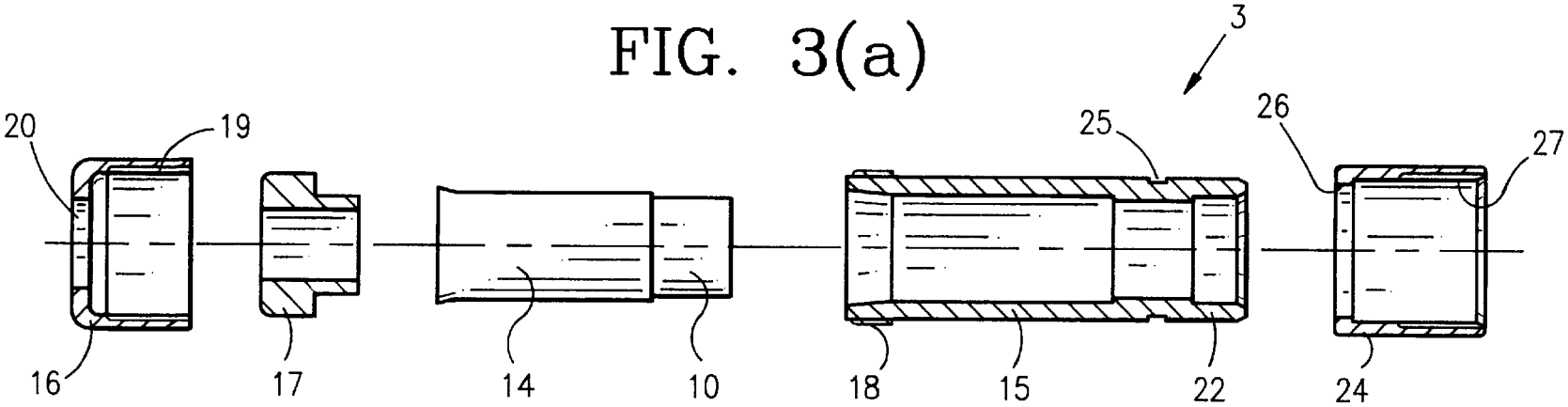
FIG. 3 represents a schematic longitudinal section of the coupling element in FIG. 1 in assembled state and in its details.
Figure 3B:
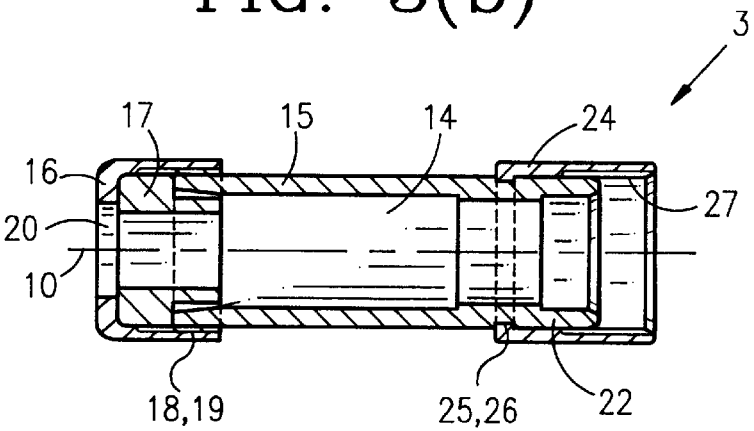

A plug connector 1 is represented in FIGS. 1 to 3, which is put together from a plug element 2 and a coupling element 3. The plug connector 1 is designed to be liquid-proof and can be employed, for example, in connection with measuring technology, in particular in environmental technology. For example, two cables can be electrically connected by means of the plug connector 1. In this case the one cable is connected with the plug element 2 and the other cable with the coupling element 3, and the plug element 2 is screwed together with the coupling element 3.

The plug connector 1 will be described by way of example by means of the two cables mentioned. However, it is expressly pointed out that in place of the two cables it is also possible to connect a sensor and/or generally another component indirectly or directly with the plug element 2 and/or the coupling element 3.

As represented in FIG. 2 in particular, the plug element 2 has a plug 4, a shroud 5, a plug housing 6 with a seal 7, a cap 8 and a seal 9. The mentioned components are essentially designed to be dynamically balanced and have a common longitudinal axis 10.

The shroud 5 is approximately interlockingly pushed on the plug 4. The plug 4 with the shroud 5 pushed thereon is inserted into the plug housing 6. The cap 8 is screwed to the plug housing 6 on the side facing away from the plug by means of two screw threads 11, 12. The seal 9 is arranged underneath the cap 8 and projects at least partially into the plug housing 6. An opening 13 is contained in the cap 8, through which a cable can be introduced in a manner not shown into the plug housing 6 and connected with the plug 4. In the connected state the cable is passed through the seal 9.

The seal 9 is embodied as a rubber bushing. With the cable connected, the seal 9 is spread apart when the cap 8 is screwed on. In this way the seal 9 comes to rest firmly against the cable, on the one hand, and on the other firmly against the inner wall of the cap 8, the front face of the plug housing 6, the inner wall of the shroud 5 and the front face of the plug 4. Thus, no liquid can pass between the screw threads 11, 12 or through the opening 13 to the plug 4 and the shroud 5. A liquid-proof connection between the cable and the plug element 2 has been achieved in this way.

As shown in FIG. 3 in particular, the coupling element 3 has a shrouded coupling 14, a coupling housing 15, a cap 16 and a seal 17. The mentioned components are embodied to be essentially dynamically balanced in relation to the longitudinal axis 10.

The coupling 14 has been inserted into the coupling housing 15. The cap 16 has been screwed to the the coupling housing 15 at the end facing away from the coupling 14 by means of two screw threads 18, 19. The seal 17 is arranged underneath the cap 16 and projects at least partially into the coupling housing 15. An opening 20 has been made in the cap 16, through which a cable can be introduced into the coupling housing 15 in a manner not represented and connected with the coupling 14. In the connected state the cable is passed through the seal 17.

The seal 17 is embodied as a rubber bushing. With the cable connected, the seal 17 is spread apart when the cap 16 is screwed on. In this way the seal 17 comes to rest firmly against the cable, on the one hand, and on the other firmly against the inner wall of the cap 16, the front face of the coupling housing 15, the inner wall of the coupling housing 15 and the front face of the coupling 14. Thus, no liquid can pass the between screw threads 18, 19 or through the opening 20 to the coupling 14. A liquid-proof connection between the cable and the coupling element 3 has in this way been achieved.

In accordance with FIG. 2, the plug housing 6 is provided on its end facing the plug 4 with a ring-shaped bushing 21 extending in the direction of the longitudinal axis 10, through which the plug 4 and the shroud 5 have been passed. The seal 7 has been placed in the approximate center of this bushing 21.

In accordance with FIG. 3, the coupling housing 15 is provided on its end facing away from the coupling 14 with a ring-shaped bushing 22, through which the coupling 14 has been passed. The interior diameter of the bushing 22 of the coupling housing 15 is slightly greater than the exterior diameter of the bushing 21 of the plug housing 6.

As represented in FIG. 1 in particular, in the assembled state of the plug connector 1 the coupling housing 15 is placed on the bushing 21 of the plug housing 6 with its bushing 22. The two bushings 21, 22 form an overlapping area 23, in which they are arranged approximately parallel with each other and at a slight distance from each other. The seal 7 is arranged inside the overlapping area 23 between the bushing 21 of the plug housing 6 and the bushing 22 of the coupling housing 15.

The seal 7 is embodied as an O-ring made of rubber. When the bushing 22 of the coupling housing 15 is placed on the bushing 21 of the plug housing 6, the seal 7 firmly rests against the two bushings 21, 22. A liquid-proof connection between the plug housing 6 and the coupling housing 15 is achieved in this way. Therefore no liquid can penetrate between the two bushings 21, 22 and reach the plug 4 and the coupling 14.

As can be seen from FIGS. 1 to 3, a locking ring 24 is associated with the coupling element 3, which surrounds the coupling housing 15 in an area facing the plug housing 6 and extending over the overlapping area 23. The locking ring 24 is essentially embodied dynamically balanced in relation to the longitudinal axis 10.

The coupling housing 15 has been provided with a notch 25 on its exterior, which is engaged by an inwardly extending protrusion 26 of the locking ring 24. By means of this the locking ring 24 can be rotated on the coupling housing 15 around the longitudinal axis 10. The locking ring 24 is provided with an interior thread 27 on its other end. An exterior thread 28 of the plug housing 6 is associated with this interior thread 27. The locking ring 24 can be screwed on the plug housing 6 by means of the screw threads 27, 28 in this way.

In the screwed together state in accordance with FIG. 1, the seal 7 is arranged within the overlapping area 23 between the plug housing 6 and the coupling housing 15. The locking ring 24 surrounds the overlapping area 23 outside of the two housings 6, 15. No seals or the like are provided between the locking ring 24 and the two housings. Liquid can therefore penetrate between the locking ring 24 and the two housings 6, 15. However, because of the seal 7 no liquid can penetrate between the two bushings 21, 22 to the plug 4 and the coupling 14.

Only the locking ring 24 is turned when assembling, or respectively unscrewing the plug element 2 and the coupling element 3. The plug housing 6 and the coupling housing 15 do not rotate in this case. Therefore the seal 7 between the two housings 6, 15 is not stressed by a rotating movement or the like.

I claim:

1. A liquid-proof plug connector, for connecting two elements, comprising:

a plug to which one element is connected;

a coupling to which the other element is connected;

a plug housing which houses said plug;

a coupling housing which houses said coupling, said coupling housing being arranged on the exterior of said plug housing in an overlapping area;

a locking ring for screwing together said plug housing and said coupling housing such that said plug housing and said coupling housing together define said overlapping area when screwed together, said locking ring being arranged on the exterior of said coupling housing in said overlapping area, said locking ring being provided with an interior thread and said plug housing with an exterior thread, said interior thread and said exterior thread serving to rotatable connect said locking ring and said coupling housing;

a seal arranged in said overlapping area between said plug housing and said coupling housing said seal being arranged on the exterior of said plug housing;

a further seal arranged between a respective element and said plug housing; and a still further seal arranged between a respective element and said coupling housing.

2. The liquid-proof plug connector as defined in claim 1, wherein said seal is fabricated of a rubber O-ring.

3. The liquid-proof plug connector as defined in claim 1, wherein said further seal and said still further seal comprise a rubber bushing.

4. The liquid-proof plug connector as defined in claim 1, further comprising:

a cap connected to said plug housing; and a cap connected to said coupling housing.

5. The liquid-proof plug connector as defined in claim 1, wherein said plug housing, said coupling housing and said locking ring are made of plastic.

6. The liquid-proof plug connector as defined in claim 1, wherein the elements are cables.

* * * * *